US006765551B2

(12) United States Patent
Nakano et al.

(10) Patent No.: US 6,765,551 B2
(45) Date of Patent: Jul. 20, 2004

(54) COLUMN ELECTRODE DRIVING CIRCUIT FOR USE WITH IMAGE DISPLAY DEVICE AND IMAGE DISPLAY DEVICE INCORPORATING THE SAME

(75) Inventors: Taketoshi Nakano, Ise (JP); Takafumi Kawaguchi, Taki-gun (JP); Toshihiro Yanagi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 485 days.

(21) Appl. No.: 09/884,414

(22) Filed: Jun. 19, 2001

(65) Prior Publication Data

US 2001/0052897 A1 Dec. 20, 2001

(30) Foreign Application Priority Data

Jun. 19, 2000 (JP) ..... 2000-183842
Mar. 23, 2001 (JP) ..... 2001-086461

(51) Int. Cl.[7] ..... G09G 3/36; G09G 5/10
(52) U.S. Cl. ..... 345/89; 345/690; 348/671
(58) Field of Search ..... 345/89, 100, 690; 348/671

(56) References Cited

U.S. PATENT DOCUMENTS 5,010,327 A * 4/1991 Wakita et al. ..... 345/89
5,594,466 A * 1/1997 Yamamoto et al. ..... 345/100
5,642,126 A * 6/1997 Okada et al. ..... 345/94
6,549,182 B2 * 4/2003 Nitta et al. ..... 345/89
6,593,904 B1 * 7/2003 Marz et al. ..... 345/87
6,661,917 B1 * 12/2003 Nagakubo et al. ..... 382/169

FOREIGN PATENT DOCUMENTS

| | | |
|---|---|---|
| JP | 06-012034 | 1/1994 |
| JP | 07-334126 | 12/1995 |
| JP | 11-015442 | 1/1999 |

* cited by examiner

*Primary Examiner*—Richard Hjerpe
*Assistant Examiner*—M. Fatahiyar
(74) *Attorney, Agent, or Firm*—David C. Conlin; George W. Hartnell, III; Edwards & Angell, LLP

(57) ABSTRACT

A column electrode driving circuit for an image display device for selecting, from among a plurality of reference voltage levels, reference voltage levels respectively corresponding to gray scale levels in input data, and outputting the respective selected voltage levels to at least one data line. The input data includes data of a first color, a second color, and a third color. The reference voltage levels are independently selected corresponding to the gray scale levels in the input data of the first, second, and third colors. Among the reference voltage levels independently selected corresponding to a given gray scale level in the input data of the first, second, and third colors, the reference voltage level selected corresponding to at least one color is different from the reference voltage level or levels selected corresponding to the other color or colors, the given gray scale level being within a predetermined range. The reference voltage level selected corresponding to the given gray scale level in the input data of the at least one color is equal to a reference voltage level selected corresponding to another gray scale level in the input data of the other color or colors.

6 Claims, 6 Drawing Sheets

* GSL: gray scale level

* GSL: gray scale level

COLUMN ELECTRODE DRIVING CIRCUIT FOR USE WITH IMAGE DISPLAY DEVICE AND IMAGE DISPLAY DEVICE INCORPORATING THE SAME

BACKGROUND OF THE INVENTION

1. Field of the Invention

The present invention relates to a column electrode driving circuit for use with an image display device for displaying images, such as characters and/or (still or moving) pictures; and an image display device incorporating such a column electrode driving circuit.

2. Description of the Related Art

A liquid crystal display device, which is one type of image display device, includes a liquid crystal display panel, which is composed essentially of a liquid crystal layer interposed between a pair of glass substrates. On one of the glass substrates of the liquid crystal display panel, a plurality of data lines (column electrodes) which are disposed in parallel to one another, and a plurality of scanning lines (row electrodes) which perpendicularly intersect the respective data lines are provided. A voltage which is applied to each pixel of the liquid crystal display panel is controlled based on a voltage which is applied to each data line. The data lines are driven by a source driver IC, which functions as a column electrode driving circuit IC.

FIG. 3 is a block diagram illustrating the internal structure of a source driver IC 1, which functions as a column electrode driving circuit IC for a conventional color liquid crystal display panel. The illustrated source driver IC 1 (column electrode driving circuit IC) has 384 outputs. The source driver IC 1 includes a shift register 2, a sampling memory 3, a hold memory 4, a D/A converter 5, an output circuit 6, and a reference voltage generation circuit 7.

The shift register 2 receives a clock signal CK and a sampling start signal SP, which are transmitted from a signal control circuit (not shown), and outputs data sampling signals to the sampling memory 3.

In accordance with the timing of the data sampling signals which are output from the shift register 2, the sampling memory 3 latches a 6-bit data signal for each color of RGB (Red, Green, Blue), which is transmitted from the signal control circuit (not shown), and stores the 6-bit data signals as 6-bit sampling data. In the case where the source driver IC 1 (column electrode driving circuit IC) has 384 outputs, the sampling memory 3 has 128 outputs for each color of RGB (i.e., a total of 384 outputs). Each of the 384 outputs is stored as 6-bit sampling data.

The 6-bit sampling data stored in the sampling memory 3 are transferred based on a data transfer signal LS which is output from the signal control circuit (not shown). The hold memory 4 stores the transferred 6-bit sampling data.

Sixty-four reference voltage lines are coupled to the D/A converter 5 from the reference voltage generation circuit 7. Sixty-four levels of voltages (corresponding to 6 bits), which are output from the reference voltage generation circuit 7, are respectively supplied on the 64 reference voltage lines. A digital/analog conversion switch (not shown) is provided for each reference voltage line. The D/A converter 5 selects a 6-bit data signal for each color of RGB (i.e., the 6-bit sampling data stored in the hold memory 4) in accordance with a designated signal level, and converts the selected signal into an analog signal to be output. Specifically, the D/A converter 5 selects (by means of the digital/analog conversion switches) one of the reference voltage lines in accordance with a designated signal level for the 6-bit data signal for each color of RGB, and outputs a signal which has been converted into an analog signal to the output circuit 6.

The output circuit 6 subjects the analog signals which have been converted by the D/A converter 5 to impedance conversion, and output the resultant analog signals as driving voltages to the data lines coupled to the respective output nodes.

In the case of a liquid crystal display panel of a liquid crystal display device, employing a DC current to drive the liquid crystal material may allow electrolysis or the like to occur at the electrode surface, whereby a rapid deterioration of the liquid crystal display panel may occur. Therefore, the liquid crystal material is typically driven by an AC driving method, in which the polarity of a voltage applied to the electrodes of the liquid crystal display panel is alternated between positive and negative. In this case, however, each of the 64 reference voltage lines, to which one of the aforementioned reference voltages of 64 levels (corresponding to 6 bits) is to be applied, must be implemented as two lines, i.e., one for the positive voltage and one for the negative voltage. Thus, 128 reference voltage lines will be required. For conciseness, only the 64 reference voltage lines for the positive or negative 64 levels will be described in the following description.

The reference voltage level which is supplied to each reference voltage line is basically generated by employing a resistance division technique between a voltage VL obtained from a low voltage reference supply and voltage VH obtained from a high voltage reference supply. For example, the respective 64 reference voltage levels which are supplied to the 64 reference voltage lines can be generated by employing 63 resistors between VL and VH.

FIG. 4 shows a chip layout of a source driver IC 1 functioning as a column electrode driving circuit IC, including a reference voltage generation circuit 7 from which 64 reference voltage lines are provided. The source driver IC 1 (column electrode driving circuit IC) includes: a D/A converter 5; and an output circuit 6. The output circuit 6 is composed essentially of an elongated rectangular IC chip, having 384 data lines in parallel connection provided on one of the longitudinal sides thereof. The 64 reference voltage lines are coupled to the D/A converter 5, which precedes the output circuit 6.

As shown in FIG. 5, the reference voltage lines L1 to L64 are respectively selectable corresponding to gray scale levels 1 to 64 of green. The reference voltage lines L1 to L64 are respectively selectable corresponding to gray scale levels 1 to 64 of red. The reference voltage lines L1 to L64 are respectively selectable corresponding to gray scale levels 1 to 64 of blue. Thus, each of the reference voltage lines L1 to L64 is associated with the same gray scale level (one of 1 to 64), for all of red, green, and blue alike. Accordingly, for each additional gray scale level which may be employed to introduce a greater multitude of gray scale levels in the liquid crystal display panel, there will be an additional reference voltage line required. Note that it is not commonly practiced in the art, when introducing an additional gray scale level, to provide an additional reference voltage line for each color of RGB (which would result in a total of three additional reference voltage lines being employed for RGB) because it is desirable to minimize any significant increase in the number of reference voltage lines, which would occupy a substantial area on the IC chip.

However, the aforementioned structure, in which the same voltage is applied for the same gray scale level irrespective of which color among RGB is addressed, has the following problem. If a given display device of any voltage-driven type has different applied voltage-luminance characteristics (or "applied voltage-transmittance characteristics" in the case of a liquid crystal display) for each of red, green, and blue, then any shift in the luminance of an achromatic display screen from a brighter state to a darker state might result in a varying chromaticity, which would otherwise be constant.

As exemplified in FIG. 6, in the case of a liquid crystal display device, the white-color chromaticity of a display screen tends to shift toward blue as the luminance of the display screen shifts from a brighter state to a darker state. This phenomenon can be explained by the liquid crystal display device possessing different gray scale level-luminance characteristics for red, green, and blue.

FIG. 7 shows an example of gray scale level-luminance characteristics. The axis of abscissas represents gray scale level 1 (dark) to level 64 (bright) of the 6-bit data for each color of RGB. The axis of ordinates represents the luminance of each color of RGB. In the graph of FIG. 7, the luminance level is normalized (unit: %) based on the assumption that any level 64 (i.e., maximum luminosity) 6-bit input data for each color of RGB has a luminance of 100%. From FIG. 7, it can be seen that the luminance value corresponding to the 6-bit data level for each color of RGB is not equal. In order to improve the color displaying performance of image display devices, it is imperative to ensure consistency among the luminance values for the respective colors of RGB.

It might appear that, in order to improve the color displaying performance of image display devices, a set of reference voltage lines (and thus reference voltage levels) could be separately provided in the column electrode driving circuit for each color of RGB, and bit correction could be performed for the 6-bit data. However, such a structure, where every three reference voltage lines would be provided for each color of RGB, would contain 192 (as opposed to 64) reference voltage lines. Since the area of such an IC chip area is inevitably increased, it may become difficult to produce the column electrode driving circuit at low cost.

Alternatively, a method might be possible which involves performing an appropriate calculation for shifting given data, by software means, to a higher or lower value. However, such a method fails to provide a fundamental solution because it would introduce some deterioration in the overall color reproducibility of RGB colors.

SUMMARY OF THE INVENTION

According to the present invention, there is provided a column electrode driving circuit for an image display device for selecting, from among a plurality of reference voltage levels, reference voltage levels respectively corresponding to gray scale levels in input data, and outputting the respective selected voltage levels to at least one data line, wherein the input data comprises data of a first color, a second color, and a third color, wherein: the reference voltage levels are independently selected corresponding to the gray scale levels in the input data of the first color, the second color, and the third color; among the reference voltage levels independently selected corresponding to a given gray scale level in the input data of the first color, the second color, and the third color, the reference voltage level selected corresponding to at least one color is different from the reference voltage level or levels selected corresponding to the other color or colors, the given gray scale level being within a predetermined range; and the reference voltage level selected corresponding to the given gray scale level in the input data of the at least one color is equal to a reference voltage level selected corresponding to another gray scale level in the input data of the other color or colors.

In one embodiment of the invention, among the reference voltage levels independently selected corresponding to a given gray scale level in the input data of the first color, the second color, and the third color, the reference voltage levels selected corresponding to the first color and the third color are shifted relative to the reference voltage level selected corresponding to the second color by a predetermined number of gray scale levels; and the column electrode driving circuit provides a number of additional reference voltage levels for interpolation purposes, the number being equal to the predetermined number.

In another embodiment of the invention, luminance values corresponding to gray scale levels of each of the first color, the second color, and the third color when displayed alone are normalized by a first max, a second max, and a third max, which respectively represent the maximum luminance values of the first color, the second color, and the third color when displayed alone; and the reference voltage levels selected corresponding to the gray scale level are selected so that the luminance values for the first color, the second color, and the third color will coincide on the basis of gray scale level-luminance characteristics expressed in terms of the normalized luminance values.

In still another embodiment of the invention, the first color, the second color, and the third color are red, green, and blue, respectively.

In still another embodiment of the invention, the first color, the second color, and the third color are cyan, magenta, and yellow, respectively.

According to another aspect of the present invention, there is provided an image display device comprising any one of the aforementioned column electrode driving circuits.

In accordance with a column electrode driving circuit for use with an image display device according to the present invention, in areas along the gray scale except for white and black, different reference voltage levels can be applied for a given gray scale level, such that a different reference voltage level can be selected for each of a first color, a second color, and a third color, whereby the luminance values of the first color, the second color, and the third color can be equalized.

Moreover, reference voltage levels corresponding to gray scale levels of the first color and the second color can be offset relative to that of the third color. In that case, additional reference voltage levels for interpolating any two or more values which have become farther apart as a result of offsetting the reference voltage levels can be employed, whereby a constant gray scale resolution can be obtained between such two or more values.

Furthermore, the luminance values corresponding to the gray scale levels of each of the first color, the second color, and the third color when displayed alone may be normalized by a first max, a second max, and a third max, which respectively represent the maximum luminance values of the respective colors when displayed alone, and the reference voltage levels according to the present invention may be set so that the luminance values for the respective colors will coincide on the basis of the gray scale level-luminance characteristics expressed in terms of such normalized luminance values representing gray scale levels. As a result, the unwanted variation in chromaticity associated with changes in the gray scale levels can be minimized.

Thus, the invention described herein makes possible the advantages of (1) providing a column electrode driving circuit with which bit correction for equalizing the luminance values of a first color, a second color, and a third color can be performed without degrading the overall color reproducibility of a color system composed of the first color, the second color, and the third color, with a minimum increase in the IC chip area; and (2) providing an image display device incorporating such a column electrode driving circuit.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of example, with reference to the accompanying figures.

Figure 2:
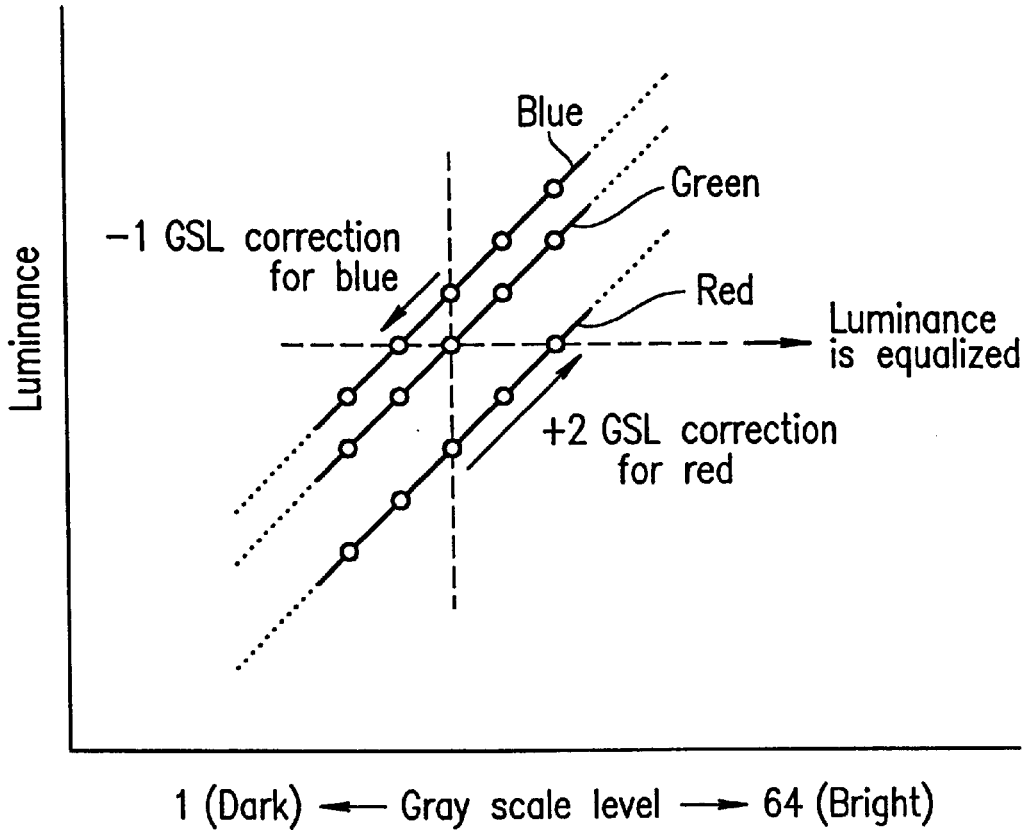
FIG. 2 is a graph illustrating exemplary bit correction performed for the luminance values of respective colors of RGB in a column electrode driving circuit according to an example of the present invention.
Figure 3:
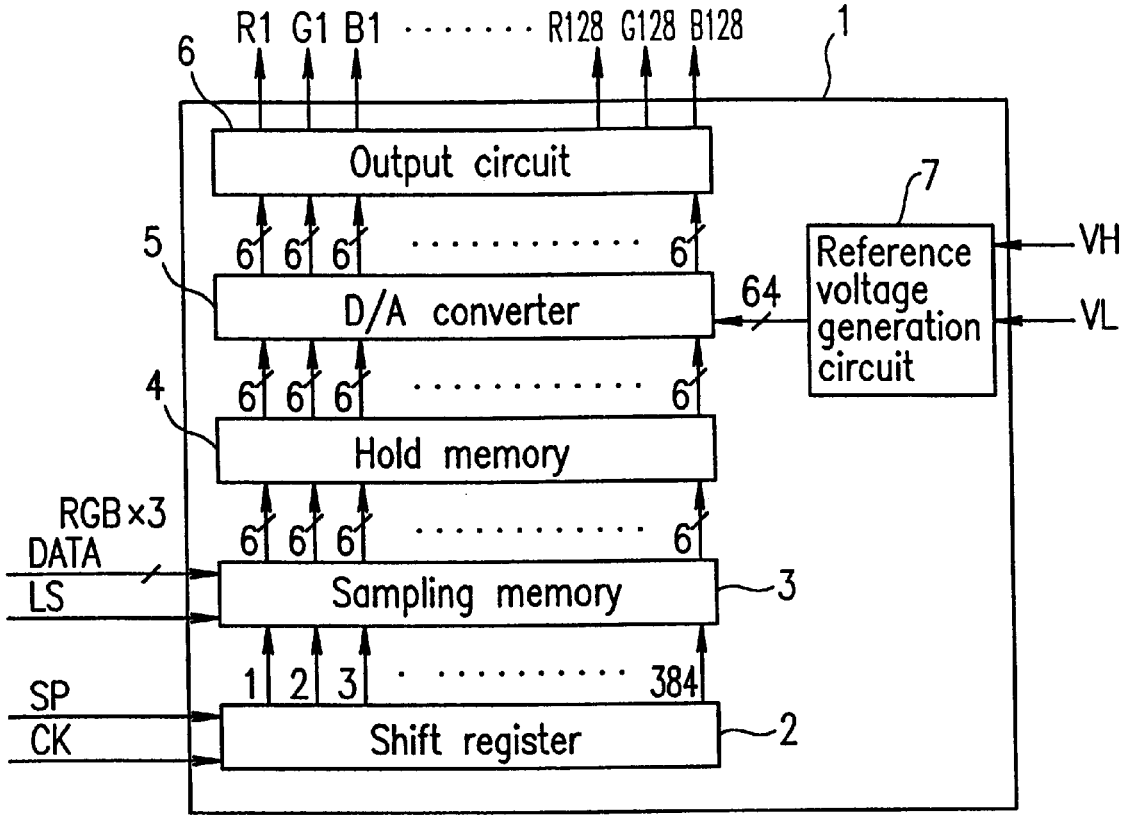
FIG. 3 is a schematic block diagram illustrating an internal structure of a source driver IC, functioning as a conventional column electrode driving circuit IC.
Figure 4:
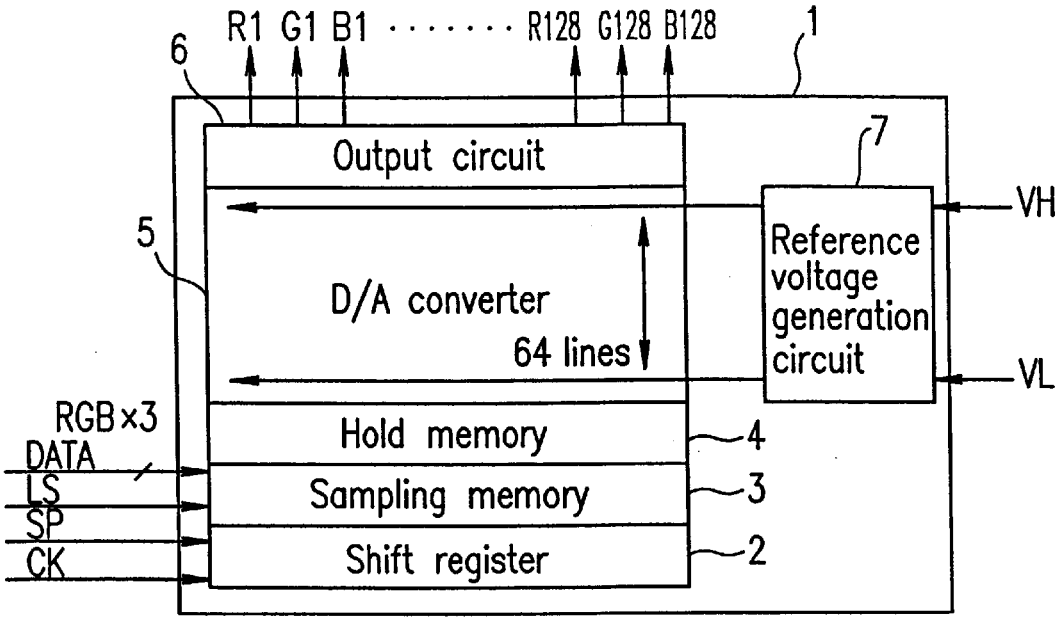
FIG. 4 is a schematic block diagram illustrating a chip layout of a source driver IC functioning as a conventional column electrode driving circuit IC, including a reference voltage generation circuit.
Figure 5:
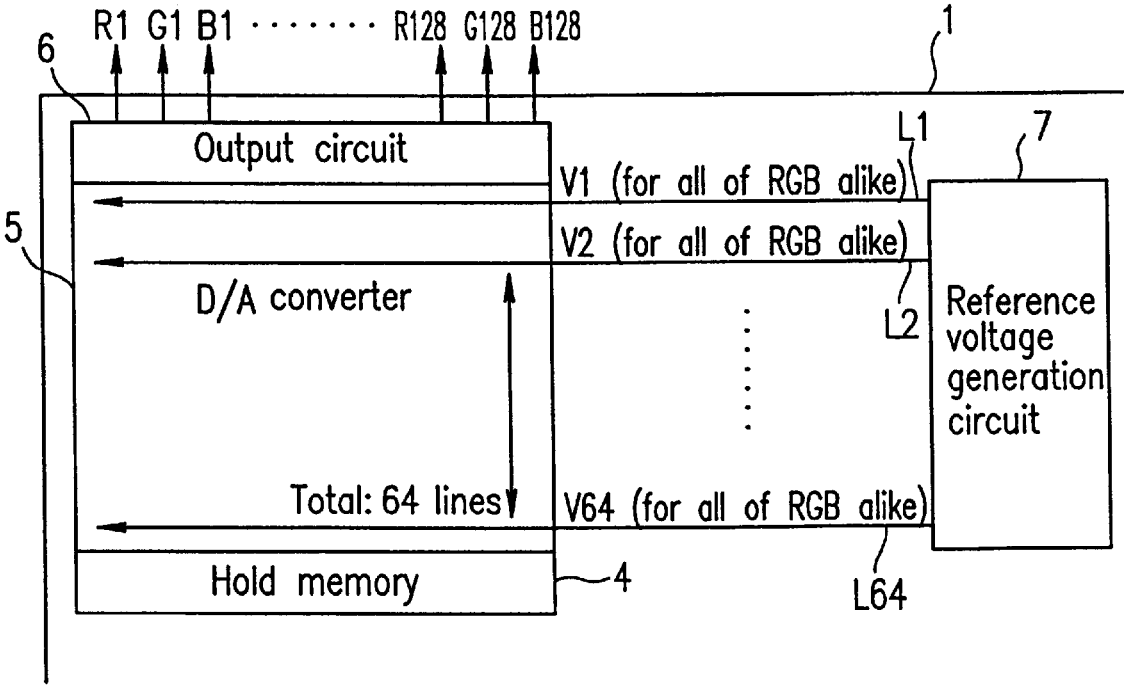
FIG. 5 is a schematic block diagram illustrating a source driver IC (a conventional column electrode driving circuit IC), where the reference voltage level corresponding to display data of each color of RGB is identical for all of the three colors.
Figure 6:
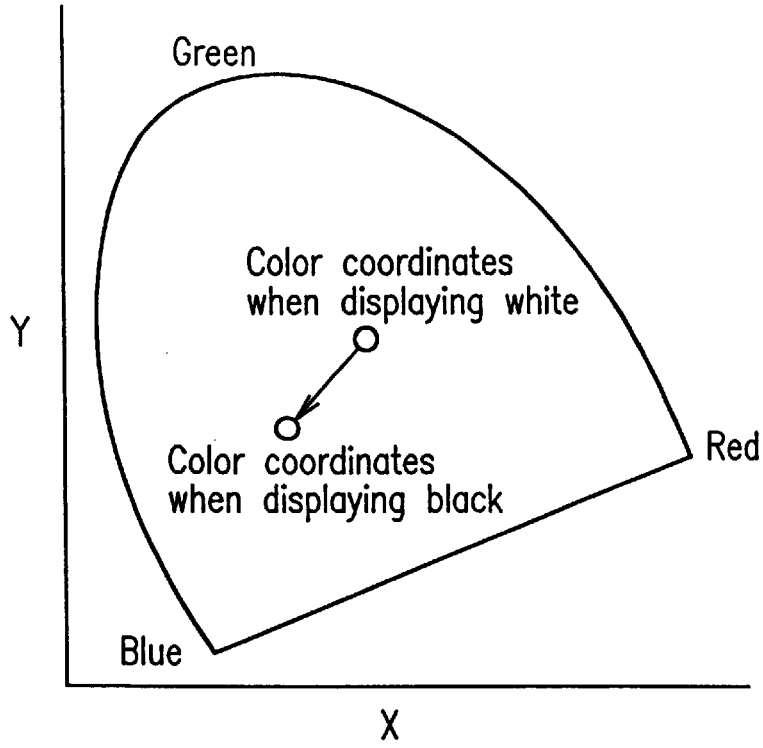
FIG. 6 is an X-Y chromaticity diagram illustrating an RGB color system.
Figure 7:
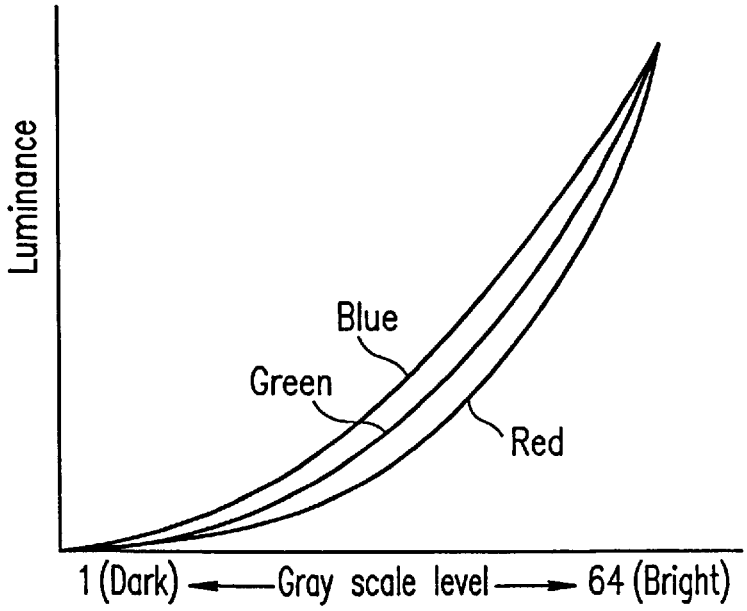
FIG. 7 is a graph illustrating offsets between RGB luminance values relative to gray scale levels.

A bit correction principle of the column electrode driving circuit according to the present invention is illustrated in FIG. 2, which shows a relationship between gray scale levels and luminance values of the respective colors of RGB when displayed on a liquid crystal display panel. The bit correction principle of the present invention pays attention to the offsets between a gray scale level of any 6-bit data (taken on the axis of abscissas) and the corresponding luminance values of red, green, and blue (taken on the axis of ordinates). It can be seen in the exemplary case shown in FIG. 2 that, as compared to the luminance value of green, the luminance value of blue is offset by one gray scale level toward the dark side of the luminance values, whereas the luminance value of red is offset by two gray scale levels toward the bright side of the luminance values. Accordingly, in order to equalize the luminance value of blue to the luminance value of green, the gray scale level of blue needs to be shifted relative to the gray scale level of green by one level toward the dark side. Similarly, in order to equalize the luminance value of red to the luminance value of green, the gray scale level of red needs to be shifted relative to the gray scale level of green by two levels toward the bright side.

Figure 1:
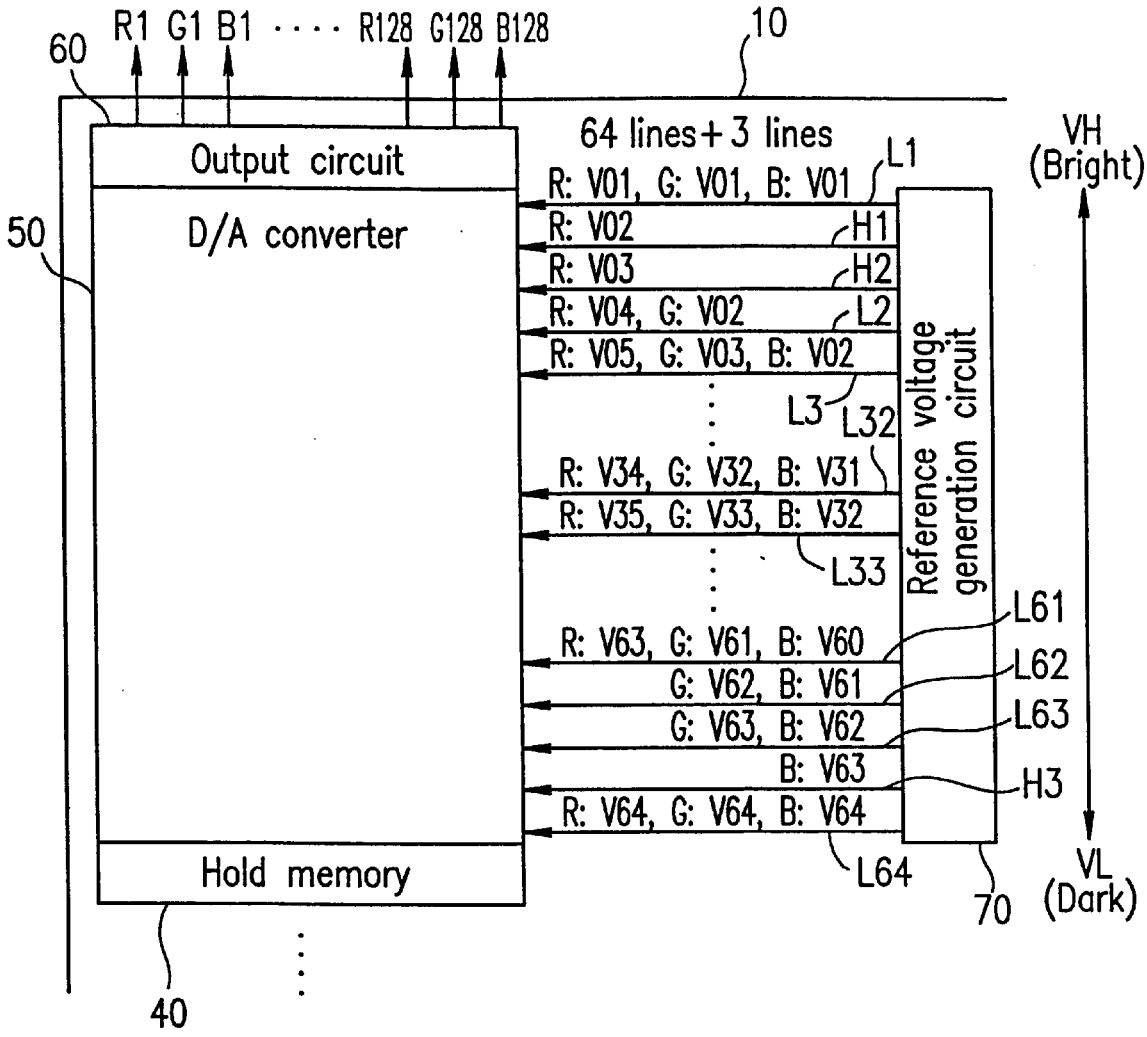
FIG. 1 is a schematic block diagram illustrating a chip layout for a source driver IC functioning as a column electrode driving circuit IC according to an example of the present invention.

FIG. 1 is a schematic block diagram illustrating a chip layout for a source driver IC embodying a column electrode driving circuit IC according to an example of the present invention.

First, 6-bit sampling data which is stored in a sampling memory (not shown) is transferred based on a data transfer signal LS which is output from a signal control circuit (not shown). A hold memory 40 stores the transferred 6-bit sampling data.

To a D/A converter 50, 64 reference voltage lines L1 to L64 and three interpolating voltage lines H1 to H3 are coupled. A digital/analog conversion switch is provided for each of the reference voltage lines L1 to L64 and the interpolating voltage lines H1 to H3. The D/A converter 50 selects a reference voltage level in accordance with the gray scale level of a 6-bit data signal for each color of RGB (which is the 6-bit sampling data stored in the hold memory 40), and converts the selected reference voltage level into an analog signal to be output. Specifically, the D/A converter 50 selects (by means of the digital/analog conversion switches) one of the voltage lines corresponding to the (64+3) reference voltages levels in accordance with the gray scale level of the 6-bit data signal (as bit-corrected) for each color of RGB, and outputs a signal which has been converted into an analog signal to an output circuit 60.

The output circuit 60 subjects the analog signals which have been converted by the D/A converter 50 to impedance conversion, and outputs the resultant analog signals as driving voltages to the data lines coupled to the respective output nodes.

To the reference voltage generation circuit 70, 64 reference voltage lines L1 to L64, to which reference voltage levels are respectively applied, are sequentially coupled (in a manner similar to the conventional 64 reference voltage lines), from a high voltage (VH) side to a low voltage (VL) side. Two interpolating voltage lines H1 and H2 are interposed between the reference voltage lines L1 and L2 on the high voltage side. One interpolating voltage line H3 is interposed between the reference voltage lines L63 and L64 on the low voltage side.

Voltages which are obtained by employing a resistance division technique with respect to a potential difference between the voltages applied to L1 and L2 are applied to H1 and H2 on the high voltage side. A voltage which is obtained by employing a resistance division technique with respect to a potential difference between the voltages applied to L63 and L64 (i.e., a mean voltage between the voltages applied to L63 and L64) is applied to H3 on the low voltage side.

Now, the bit correction principle of the column electrode driving circuit according to the present invention will be more specifically described, with continued reference to FIG. 1.

Corresponding to gray scale levels 1 to 64 of green, the reference voltage lines L1 to L64 are selected, respectively.

Corresponding to gray scale level 1 or 64 of red, the reference voltage line L1 on the high voltage (VH) side or the reference voltage line L64 on the low voltage (VL) side is selected, respectively. Corresponding to gray scale level 2 or 3 of red on the bright side, the interpolating voltage lines H1 or H2 is selected, respectively, by setting the analog switch selection circuits. Corresponding to gray scale levels 4 to 63 of red, the reference voltage lines L2 to L61 are selected, respectively, such that the gray scale levels of red are upshifted by 2 gray scale levels toward the high voltage (VH) side (i.e., the bright side) relative to their corresponding gray scale levels 2 to 61 of green, by setting the analog switch selection circuits.

Corresponding to gray scale level 1 or 64 of blue, the reference voltage line L1 on the high voltage (VH) side or the reference voltage line L64 on the low voltage (VL) side is selected, respectively. Corresponding to gray scale levels 2 to 62 of blue, the reference voltage lines L3 to L63 are selected, respectively, such that the gray scale levels of blue are downshifted by 1 gray scale level toward the low voltage (VL) side (i.e., the dark side) relative to their corresponding gray scale levels 3 to 63 of green, by setting the analog switch selection circuits. Corresponding to gray scale level 63 of blue on the dark side, the interpolating voltage line H3 is selected by setting the analog switch selection circuits.

Accordingly, for example, the reference voltage line L33 is selected for gray scale level 33 of green, gray scale level 35 of red, or gray scale level 31 of blue. Thus, the same reference voltage level is applied for different gray scale levels (i.e., 35, 33, and 31) of red, green, and blue, respectively. As a result, images can be displayed on the liquid crystal display panel with equal luminance values for all of RGB. Moreover, the interpolating voltage lines H1 and H2 for correcting for the 2-level upshift in the gray scale levels of red are provided on the bright side of the gray scale. In addition, the interpolating voltage line H3 for correcting for the 1-level downshift in the gray scale levels of blue is provided on the dark side of the gray scale. Thus, even though different reference voltage levels are applied corresponding to the same gray scale level, such that the gray scale levels of red and blue are shifted relative to the gray scale levels of green, the total color reproducibility over the entire liquid crystal display panel is prevented from degrading.

In the structure shown in FIG. 1, the number of additional voltage lines (and thus the number of additional reference voltage levels) is equal to the number of gray scale levels by which red and blue are shifted relative to green for equalizing the luminance values of all of RGB. Alternatively, a greater number of additional voltage lines (and thus a greater number of additional reference voltage levels) than the number of gray scale levels by which red and blue are shifted relative to green may be employed.

For example, the number of reference voltage lines may be increased from 64 to about 80, and a gray scale level correction may be performed by shifting the reference voltage levels for red and blue by any arbitrary number (which may be one or more) of gray scale levels, relative to a reference voltage level corresponding to a given luminance value of green. As a result, the luminance values of the respective colors of RGB can be equalized with an even higher resolution.

In accordance with the aforementioned structure of the present invention, the color displaying performance of an image display device can be improved by employing a smaller number of reference voltage lines for applying reference voltage levels than in a structure in which reference voltage lines are provided corresponding to the luminance values of each color of RGB separately. As a result, the IC chip area can be maintained sufficiently small according to the present invention.

The reference voltage lines may be placed in any appropriate position so as to conform to the locations of other internal elements of the image display device.

The luminance values corresponding to the respective gray scale levels of each color of red, green, or blue when displayed alone may be normalized by Rmax, Gmax, or Bmax, which respectively represent the maximum luminance values of red, green, and blue when each of these colors is displayed alone, and the reference voltage levels according to the present invention may be set so that the luminance values for the respective colors of RGB will coincide on the basis of the gray scale level-luminance characteristics expressed in terms of such normalized luminance values representing gray scale levels.

Figure 8:
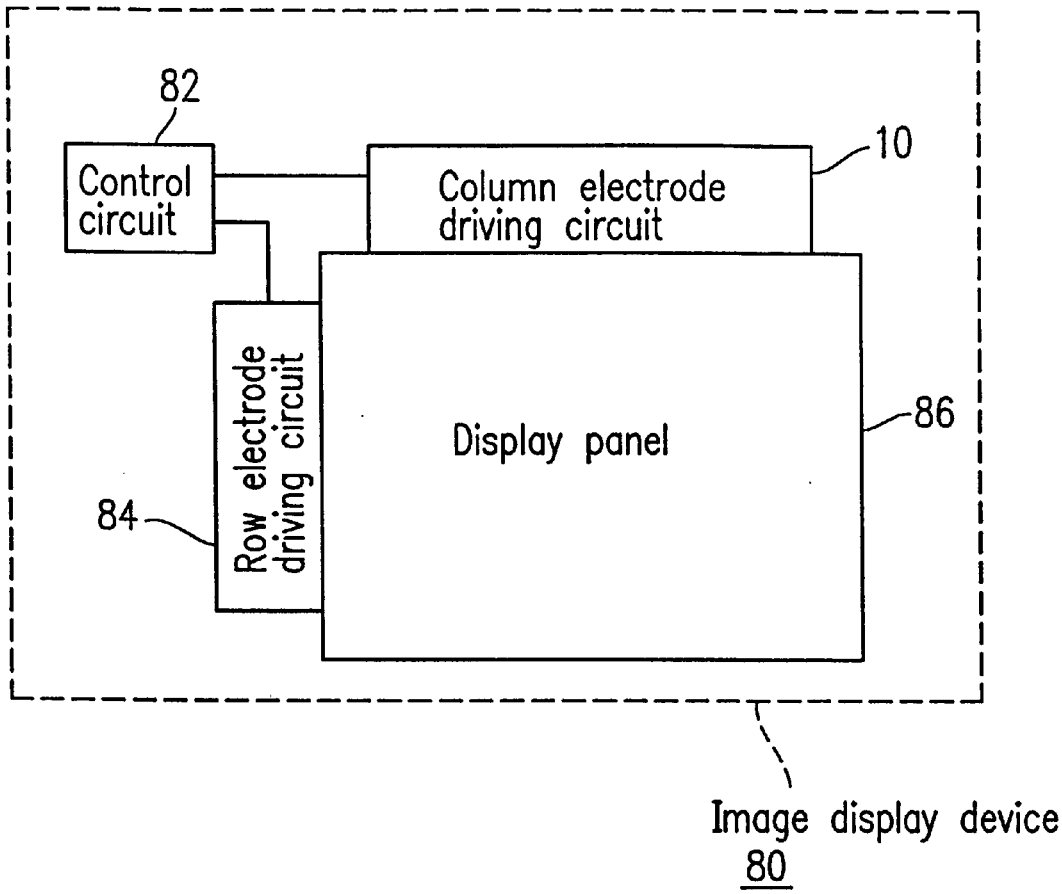
FIG. 8 is a block diagram illustrating an image display device incorporating a column electrode driving circuit according to the present invention.

FIG. 8 is a block diagram illustrating an image display device 80 incorporating a column electrode driving circuit 10 according to the present invention. The image display device 80 includes the column electrode driving circuit 10, a control circuit 82, a row electrode driving circuit 84, and a display panel 86. The luminance of the display panel 86 is controlled according to the principle of the present invention. An output circuit 60 (FIG. 1) in the column electrode driving circuit 10, as described above, applies impedance conversion to analog signals which have been converted by a D/A converter 50 (FIG. 1), and outputs the resultant analog signals as driving voltages to the data lines coupled to the respective output nodes.

Although a TFT liquid crystal display device is illustrated in the above example, the present invention is applicable to a wide range of matrix-type image display devices incorporating a column electrode driving circuit, e.g., MIM, simple matrix liquid crystal display devices, PALC, PDP, EL, etc.

Although a TFT liquid crystal display device in which input data of red, green, and blue are employed is illustrated in the above example, these colors may be any three monochromatic colors (a first color, a second color, and a third color) composing a color system. For example, the effects of the present invention can be attained by employing a color system of cyan, magenta, and yellow.

Thus, in accordance with a column electrode driving circuit for use with an image display device according to the present invention, gray scale levels of a first color, a second color, and a third color are selected such that the gray scale level-luminance characteristics of the first color, the second color, and the third color become identical, and reference voltage levels corresponding to the selected gray scale levels of the first color, the second color, and the third color are applied to respective data lines on a display panel. As a result, good overall reproducibility for the three colors can be realized while preventing substantial increase in the IC chip area.

In accordance with a column electrode driving circuit for use with an image display device according to the present invention, reference voltage levels corresponding to gray scale levels of the first color and the second color can be offset relative to that of the third color. In that case, additional reference voltage levels for interpolating any two or more values which have become farther apart as a result of offsetting the reference voltage levels can be additionally employed, whereby a constant gray scale resolution can be obtained between such two or more values. The number of additional reference voltage lines to be employed can be reduced, and thus, the IC chip area can be maintained sufficiently small.

Furthermore, in accordance with a column electrode driving circuit for use with an image display device according to the present invention, the luminance values corresponding to the respective gray scale levels of each color when displayed alone may be normalized by the maximum luminance values of the respective colors when displayed alone, and the reference voltage levels may be set so that the luminance values for the respective colors will coincide on the basis of the gray scale level-luminance characteristics expressed in terms of such normalized luminance values representing gray scale levels. As a result, an unwanted variation in chromaticity associated with changes in the gray scale levels can be minimized, so that the white balance can be maintained despite changes in the luminance of displayed images.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A column electrode driving circuit for an image display device for selecting, from among a plurality of reference voltage levels, reference voltage levels respectively corresponding to gray scale levels in input data, and outputting the respective selected voltage levels to at least one data line, wherein the input data comprise data of a first color, a second color, and a third color, wherein:

the reference voltage levels are independently selected corresponding to the gray scale levels in the input data of the first color, the second color, and the third color;

among the reference voltage levels independently selected corresponding to a given gray scale level in the input data of the first color, the second color, and the third color, the reference voltage level selected corresponding to at least one color is different from the reference voltage level or levels selected corresponding to the other color or colors, the given gray scale level being within a predetermined range; and the reference voltage level selected corresponding to the given gray scale level in the input data of the at least one color is equal to a reference voltage level selected corresponding to another gray scale level in the input data of the other color or colors.

2. A column electrode driving circuit according to claim 1, wherein:

among the reference voltage levels independently selected corresponding to a given gray scale level in the input data of the first color, the second color, and the third color, the reference voltage levels selected corresponding to the first color and the third color are shifted relative to the reference voltage level selected corresponding to the second color by a predetermined number of gray scale levels; and the column electrode driving circuit provides a number of additional reference voltage levels for interpolation purposes, the number being equal to the predetermined number.

3. A column electrode driving circuit according to claim 1, wherein:

luminance values corresponding to gray scale levels of each of the first color, the second color, and the third color when displayed alone are normalized by a first max, a second max, and a third max, which respectively represent the maximum luminance values of the first color, the second color, and the third color when displayed alone; and the reference voltage levels selected corresponding to the gray scale levels are selected so that the luminance values for the first color, the second color, and the third color will coincide on the basis of gray scale level-luminance characteristics expressed in terms of the normalized luminance values.

4. A column electrode driving circuit according to claim 1, wherein the first color, the second color, and the third color are red, green, and blue, respectively.

5. A column electrode driving circuit according to claim 1, wherein the first color, the second color, and the third color are cyan, magenta, and yellow respectively.

6. An image display device comprising a column electrode driving circuit for selecting, from among a plurality of reference voltage levels, reference voltage levels respectively corresponding to gray scale levels in input data, and outputting the respective selected voltage levels to at least one data line, wherein the input data comprise data of a first color, a second color, and a third color wherein:

the reference voltage levels are independently selected corresponding to the gray scale levels in the input data of the first color, the second color, and the third color;

among the reference voltage levels independently selected corresponding to a given gray scale level in the input data of the first color, the second color, and the third color, the reference voltage level selected corresponding to at least one color is different from the reference voltage level or levels selected corresponding to the other color or colors, the given gray scale level being within a predetermined range; and the reference voltage level selected corresponding to the given gray scale level in the input data of the at least one color is equal to a reference voltage level selected corresponding to another gray scale level in the input data of the other color or colors.

* * * * *